US005962382A

United States Patent [19]

Lambino

[11] Patent Number: 5,962,382

[45] Date of Patent: Oct. 5, 1999

[54] CLEAR, COLORLESS SOAP BAR WITH SUPERIOR MILDNESS, LATHERING AND DISCOLORATION RESISTANCE

[75] Inventor: Danilo L. Lambino, Quezon City, Philippines

[73] Assignee: Johnson & Johnson Consumer Products, Inc., Skillman, N.J.

[21] Appl. No.: 08/956,225

[22] Filed: Oct. 22, 1997

Related U.S. Application Data

[62] Division of application No. 08/673,869, Jul. 2, 1996, Pat. No. 5,728,663.

[51] Int. Cl.[6] ..... C11D 17/00; C11D 9/00; C11D 9/32

[52] U.S. Cl. ..... 510/147; 510/130; 510/141; 510/152; 510/483

[58] Field of Search ..... 510/130, 147, 510/152, 141, 153, 447, 454, 483, 499, 488

[56] References Cited

U.S. PATENT DOCUMENTS

| | | |
|---|---|---|
| 2,820,768 | 1/1958 | Fromond . |
| 2,921,907 | 1/1960 | Kleyn et al. . |
| 3,793,214 | 2/1974 | O'Neill et al. . |
| 3,926,828 | 12/1975 | O'Neill et al. ..... 252/117 |
| 4,290,904 | 9/1981 | Poper et al. . |
| 4,468,338 | 8/1984 | Lindberg . |
| 4,758,370 | 7/1988 | Jungermann et al. . |
| 5,310,495 | 5/1994 | Hill et al. . |

FOREIGN PATENT DOCUMENTS

| | | |
|---|---|---|
| 0 335 026 | 10/1989 | European Pat. Off. . |
| 8018 | 9/1995 | Philippines . |

OTHER PUBLICATIONS

Frosch. et al., Am. Acad. Dermatol. (35–41) (1979).
Abstract –JPO6200298A to Tamanohada ( Jul. 19, 1994).
Abstract –SU 1708827A to Chlovek Coop ( Jan. 30, 1992).

*Primary Examiner*—Yogendra N. Gupta
*Assistant Examiner*—Gregory E. Webb
*Attorney, Agent, or Firm*—Michele G. Mangini; Ruby Hope

[57] ABSTRACT

The present invention relates to a clear colorless soap bar with superior mildness, lathering and discoloration resistance. The clear colorless soap consists of a blend of C12–C18 fatty acids neutralized with sodium hydroxide (NaOH) and triethanolamine (TEA). Excess TEA acts as a co-solvent and is responsible for clarity of the soap bar. The bar also contains a branched chain acid such as isostearic acid to break up crystallinity and add to product clarity. Low color and color stability are obtained by removing unsaturated fatty acids, and by the use of antioxidants (BHT and Vitamin E). Low levels of C6 to C10 fatty acids provide exceptional mildness.

23 Claims, 2 Drawing Sheets

CLEAR, COLORLESS SOAP BAR WITH SUPERIOR MILDNESS, LATHERING AND DISCOLORATION RESISTANCE

This is a division of application Ser. No. 08/673,869, filed Jul.2, 1996, now U.S. Pat. No. 5,728,663, which is hereby incorporated by reference.

FIELD OF THE INVENTION

This invention relates to a clear soap bar with exceptional resistance to discoloration on aging and which is extremely mild to the skin.

BACKGROUND OF THE INVENTION

U.S. Pat. No. 2,820,768 (Fromont) discloses that transparent soap can be made by mixing and heating to a temperature of 100 to 120° C. a transparent alkali metal soap with the reaction product of a fatty acid containing no less than 18 carbon atoms with excess triethanolamine. The soap preferably contains approximately 30% castor oil to improve transparency. Ricinoleates obtained from castor oil were found to dissolve fatty acid salts such as stearates, thus inhibiting crystallization of the soap on cooling.

U.S. Pat. No. 3,793,214 (O'Neill et. al.) discloses that transparent soap bars may be made by neutralizing a mixture of saturated fatty acids and C5 to C18 branched chain fatty acids with a neutralizing agent comprising a sodium compound and an alkanolamine, preferably, triethanolamine. The neutralizing compound contains sufficient sodium compound to neutralize at least 40 percent of the fatty acids. The neutralizing agent also contains sufficient alkanolamine to provide 15 to 45 weight percent of free alkanolamine in the final soap bar composition. The soap contains from 10 to 20 parts of branched chain fatty acid for each 100 parts of soap. Examples of suitable branched chain acids are trialkyl acetic acids commonly known as neo-acids, and 2-ethylhexanoic acid. In the preparation of the bars disclosed, the fatty acids are heated with sodium hydrosulfite to a temperature of 130 to 210° F. (54 to 99° C.) with stirring until homogeneous, and to this are added a pre-blend of the neutralizing agent and water. O'Neill et. al. also disclose that other components, e.g., preservatives, antioxidants, colorants and perfumes may also be present in the formulation. Following the neutralization step, the other components are then added, the mixture is stirred until homogeneous, and it is then poured into molds to cool and form soap bars.

U.S. Pat. No. 4,290,904 (Poper et. al.) discloses that a transparent soap may be made by saponifying a fatty oil, preferably, a mixture of tallow, coconut and castor oils, with caustic soda, water and a polyhydric alcohol. The soap also contains a tetrakis (hydroxyalkyl) ethylenediamine, which may be added either before or after saponification. Additional surfactants to increase foaming and to stabilize the foam, such as amine oxides and alkyl diethanolamides, are desirably added. Other components that may be added include chelating agents, colors, antioxidants and perfumes.

U.S. Pat. No. 4,468,338 (Lindberg) discloses that a transparent soap bar that does not lose its transparency or otherwise darken over time can be formulated from a mixture of alkali metal and triethanolamine salts of C6 to C18 fatty acids, citric acid or one of is alkali metal salts, an alkali metal metabisulfite and water. The fatty acids have an iodine number between 8 and 15.

U.S. Pat. No. 4,758,370 (Jungermann, et. al.) discloses a process for the continuous production of transparent soap. In their process, a mixture of fatty acids, which may include coco fatty acids, stearic acid, oleic acid, ricinoleic acid and other acids, is blended in a first storage tank. Sodium hydroxide solution, which may or may not contain other agents such as triethanolamine, is maintained in a second storage tank. The contents of the two tanks are blended together in a heated, stirred tank reactor at precise stoichiometric ratios to produce a composition which when placed in molds and cooled, hardens to a transparent soap bar. Jungermanri et al. claim the benefit of speed, easier control, and the production of a lighter, more uniform product. They also disclose that inclusion of materials such as antioxidants, BHA, BHT, tocopherol, tocopherol acetate, sodium metabisulfite, chelating agents EDTA and DTPA, isostearic acid, and neo-decanoic acid may be added without adversely affecting the primary characteristics required.

U.S. Pat. No. 5,310,495 and European Patent 0335026B1 (both to Hill, et. al.) disclose transparent soap bars made from carefully controlled compositions. These patents disclose compositions which comprise a mixture of alkanolammonium and alkali metal C12 to C22 fatty acid salts, the mole ratio of these being from 0.1 to less than 1.0. A liquid solvent system comprising water and triethanolamine is also present, the weight ratio of these being from greater than 0.25 to less than 1.0. The weight ratio of total fatty acid salts to solvent must range from greater than 0.2 to less than 1.0. While these patents suggest that unsaturated soaps give bars with a characteristic yellow color, they state that the soaps may contain unsaturation in accordance with commercially acceptable standards, though excessive unsaturation is normally avoided.

Philippine Utility Model 8018 (Dy Dumalasa, et. al.) teaches a transparent soap bar made from low iodine value fatty acids. Butylated hydroxy toluene (BHT) is added to the soap formulation to retard discoloration. The fatty acids used in this soap include 2-ethyl hexanoic acid, topped coconut fatty acids, triple pressed stearic acid and lauric acid.

Disadvantages of the soap bars produced according to the above disclosures is that the soaps exhibit varying degrees of clarity , color and color stability. Furthermore, the soaps of the prior art tend to discolor to varying degrees on aging. This discoloration is especially pronounced at the higher temperatures encountered in warm climates where air conditioning is less common. Furthermore, the soap bars of the prior art tend to irritate sensitive skin.

Accordingly, it is an object of the present invention to provide a soap bar of exceptional clarity and low color.

A further object of the present invention to provide a clear, colorless soap bar which resists discoloration on aging.

Yet a further object of this invention to provide a soap bar that can be made from fatty acids that are entirely plant-derived.

In another object of the present invention there is provided a clear, colorless soap bar which is sufficiently mild to the skin to permit its regular use by individuals with sensitive skin, for example, infants.

SUMMARY OF THE INVENTION

A clear soap bar which resists discoloration on aging and which is extremely mild to the skin comprises 0.1 to 1.0 percent by weight of a reducing agent, about 40 to about 65 percent by weight of a mixture of alkali metal and alkanolamine salts of C6 to C22 carboxylic acids, about 35 to about 60 percent by weight of a solvent mixture comprising water and alkanolamine, and a discoloration-retarding effective amount of an antioxidant to retard the discoloration of the soap bar on aging, wherein about 2 to about 20 weight percent of the carboxylic acids are branched carboxylic acids, and wherein the carboxylic acids from which the carboxylic acid salts in the soap bar are derived have an iodine number less than or equal to about 2.0.

In a preferred embodiment, the reducing agent is selected from alkali metal metabisulfite, alkali metal sulfite, alkali metal bisulfite and alkali metal hydrosulfite, and is most preferably sodium hydrosulfite, The reducing agent is present in the soap bar at a concentration of about 0.2 to about 0.6 percent by weight and most preferably at a concentration of 0.4 percent by weight. The alkanolamine is triethanolamine, about 50 to about 55 percent by weight of the soap bar comprises a mixture of sodium and triethanolamine salts of C6 to C22 carboxylic acids, the weight ratio of sodium salts to triethanolamine salts being preferably from about 25:75 to about 75:25, most preferably from about 45:55 to about 55:45; at least about 80 percent by weight and most preferably at least about 90 percent by weight of the carboxylic acids from which the carboxylic acid salts in the soap bar are derived are C12 to C18 straight chain, saturated carboxylic acids, the soap bar comprises from about 35 to 60 percent by weight and most preferably from about 40 to about 55 percent by weight of a solvent mixture which comprises from about 65 to about 85 percent and most preferably from about 70 to about 75 percent by weight triethanolamine. The antioxidant is selected from alkylated phenols and their derivatives, Vitamin E and its derivatives, and mixtures thereof, and more preferably, the antioxidant comprises a first antioxidant selected from butylated hydroxy toluene and butylated hydroxy anisole at a concentration of about 0.001 to about 0.1 percent by weight and a second antioxidant selected from Vitamin E and Vitamin E acetate at a concentration of about 0.01 to about 1.0 percent by weight. Even more preferably, the first antioxidant is butylated hydroxy toluene and is present in the soap bar at a concentration of about 0.005 to about 0.05 percent by weight, and the second antioxidant is Vitamin E and is present in the soap bar at a concentration from about 0.05 to about 0.5 percent by weight. Further, more preferably the branched carboxylic acids are selected from the iso acids, neo acids, 2-ethyl hexanoic acid and mixtures thereof, and more preferably, the branched carboxylic acid is selected from isostearic acid, 2-ethyl-hexanoic acid and mixtures thereof and comprises from about 2 to about 10 percent of the carboxylic acids from which the soap bar is derived.

The soap bar may also contain ancillary agents such as foam stabilizers, humectants, emollients, fragrances and chelating agents. Examples of foam stabilizers include alkyl monoethanolamides, alkyl diethanolamides, acyl sarcosinates, acyl taurates, acyl isethionates, acyl lactates, alkyl amine oxides, alkyl betaines and mixtures thereof. Examples of humectants include glycerine, propylene glycol, butylene glycol, polyethylene glycol, and mixtures thereof. Examples of emollients include mineral oil, vegetable oil, silicone oils, synthetic and semisynthetic emollient esters and mixtures thereof. Examples of chelating agents include the tetrasodium salt of ethylenediamine tetraacetic acid and the pentasodium salt of diethylenetriamine pentaacetic acid.

In the preferred soap bars of the present invention, the carboxylic acids from which the carboxylic acid salts in the soap bar are derived comprises from zero to less than about 0.5 percent by weight of C6 to C10 linear, straight chain carboxylic acids. In some regions of the world, it is preferred that the carboxylic acids from which the soap bar is derived be entirely of plant origin, and this requirement may be accommodated by the soap bars of the present invention.

Also disclosed is a process for making the soap bar which includes the steps of providing a mixture of C6 to C22 carboxylic acids wherein about 2 to about 20 weight percent of the carboxylic acids are C8 to C18 branched carboxylic acids and wherein the carboxylic acids have an iodine number less than or equal to about 2.0, heating the mixture of C6 to C22 carboxylic acids to produce a molten mixture of carboxylic acids, admixing a reducing agent with the molten carboxylic acids, admixing less than a molar equivalent of alkali metal hydroxide with the C6 to C22 carboxylic acids, affording a mixture of unneutralized carboxylic acids with neutralized carboxylic acids, admixing alkanolamine with the mixture of unneutralized carboxylic acids and neutralized carboxylic acids, affording a mixture of alkali metal and alkanolamine salts of the C6 to C22 carboxylic acids, providing sufficient excess of alkanolamine to function as a solvent which increases the clarity of the soap bar, thereby providing a mixture of carboxylic acid salts and solvent comprising alkanolamine, admixing a discoloration-retarding effective amount of an antioxidant to the carboxylic acid salts and solvent, transferring the molten mixture of salts and solvent into molds, and cooling the molds to harden the molten soap into solid soap. In the neutralization of the acids, the alkali metal hydroxide may be mixed with the acids before addition of the alkanolamine, the alkanolamine addition may precede the neutralization with alkali metal hydroxide, or the neutralization with alkali metal hydroxide and alkanolamine may be conducted simultaneously.

DETAILED DESCRIPTION OF THE INVENTION

Figure 1:
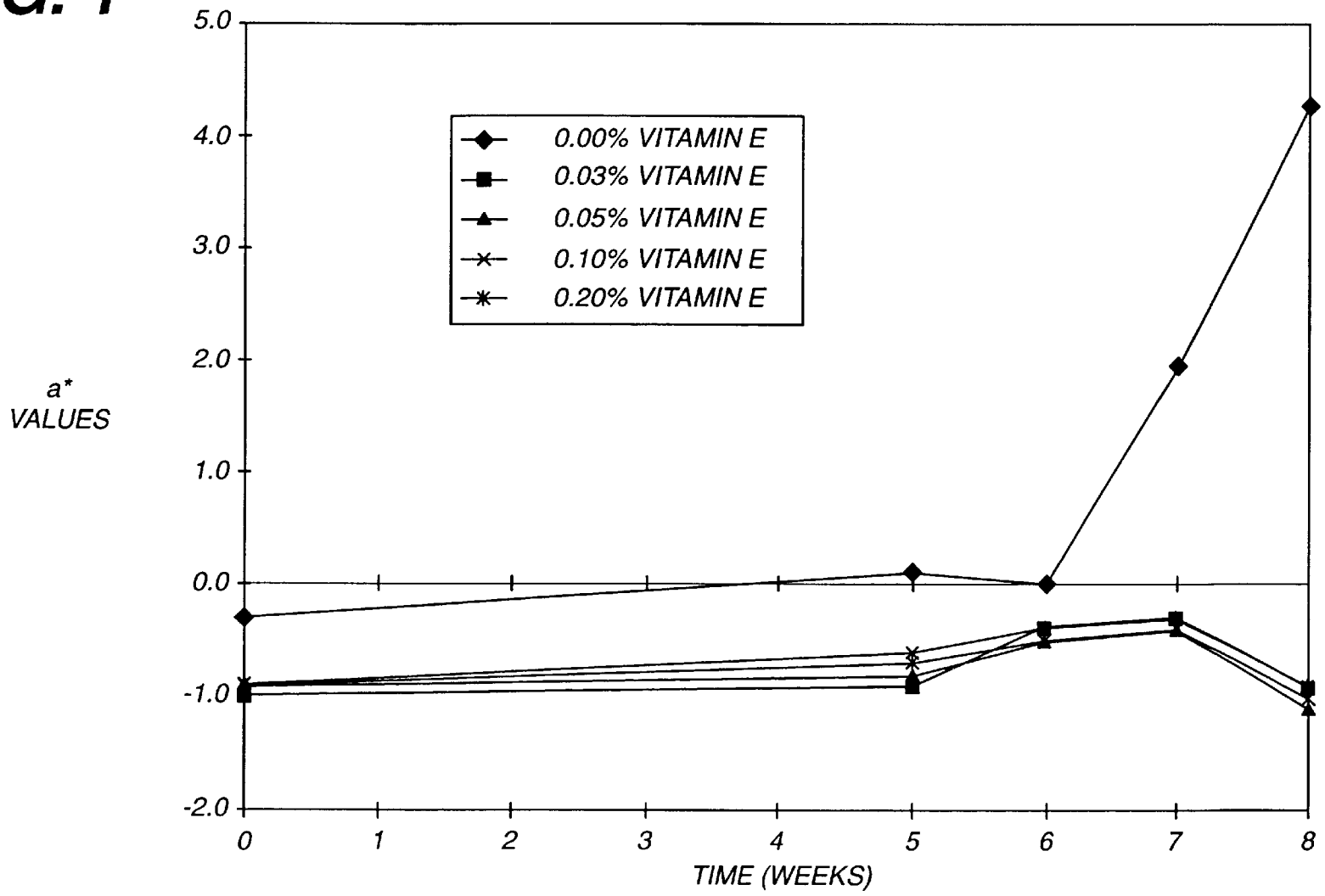
FIG. 1 is a graph showing the effect of aging on the a* color value of the soap bars of the present invention.

The present invention is a clear soap bar of exceptionally low color which resists discoloration on aging, and the process for making this soap bar. The soap bar of the present invention is very mild, and it can, therefore, be used on a regular basis by individuals with sensitive skin, for example, infants.

The soap bar of the present invention comprises the following:

a. 0.1 to 1.0 percent by weight of a reducing agent,
b. about 40 to about 65 percent by weight of a mixture of alkali metal and alkanolamine salts of C6 to C22 carboxylic acids,
c. about 35 to 60 percent by weight of a solvent mixture comprising water and an alkanolamine,
d. a discoloration-retarding effective amount of an antioxidant to retard the discoloration of the soap bar on aging.

In the soap bars of the present invention, about 2 to about 20 weight percent of the carboxylic acids from which the carboxylic acids salts are derived are branched chain carboxylic acids. The carboxylic acids possess very low levels of unsaturation, as evidenced by an iodine number less than or equal to a value of about 2.0.

The soap bars of the present invention contain a reducing agent at a concentration of about 0.1 to about 1.0 percent by weight. The reducing agent is preferably an inorganic sulfurous salt selected from alkali metal metabisulfite, alkali metal sulfite, alkali netal bisulfite and alkali metal hydrosulfite. The alkali metal in the inorganic sulfurous salt may be sodium or potassium, although sodium is preferred. The preferred reducing agent is sodium hydrosulfite, and it is most preferably added to the soap bar ingredients at a concentration of about 0.2 to about 0.6 percent by weight. The reducing agent is believed to function by reducing the color-bodies that are present in some of the fatty acid ingredients, as well as some of the impurities that contribute to the formation of color bodies in the soap over time.

The soap bars of the present invention contain about 40 to about 65 percent by weight of a mixture of alkali metal and alkanolamine salts of C6 to C22 fatty acids. The alkali metal may be sodium, potassium, or mixtures of sodium and potassium, although sodium is preferred. The alkanolamine is preferably triethanolamine, although minor amounts of other alkanolamines such as diethanolamine may also be present.

The carboxylic acids salts in the soap bars of the present invention are formed by the neutralization of fatty acids with a mixture of alkaline materials comprising alkali metal hydroxide and an alkanolamine, preferably, sodium hydroxide and triethanolamine. Since sodium hydroxide is the stronger base, it will react preferentially with the fatty acids in the neutralization step. Thus, in order to form a mixture of alkali metal and alkanolamine salts, less than one mole of alkali metal hydroxide must be used for each mole of fatty acid. Any fatty acid left unneutralized by the molar deficiency of alkali metal hydroxide will then be neutralized by the alkanolamine.

The weight ratio of alkali metal carboxylic acid salt to alkanolamine salt in the soap bars of the present invention preferably ranges from 25:75 to about 75:25, and more preferably ranges from 55:45 to 45:55. For example, using the distribution of fatty acids described in the following Example 1, the carboxylic acids have an average molecular weight of about 236. In Example 1, the carboxylic acids are neutralized with sodium hydroxide and triethanolamine. The weight ratio of sodium salts of the carboxylic acids to the triethanolamine salts of the carboxylic acids in the soap bar made according to Example 1 is 27.4:24.7, or 1.11:1. This ratio of salts is produced by reacting each mole of carboxylic acids with about 0.63 moles of sodium hydroxide and neutralizing the remainder of the acids with triethanolamine.

In forming the fatty acid salts comprising the soap bars of the present invention, the neutralization step may be conducted by sequentially reacting the fatty acids with each of the alkaline materials added separately, or by reacting the fatty acids with a combination of the alkaline materials.

The carboxylic acid salts which comprise the soap bars of the present invention are derived from C6 to C22 fatty acids. Preferably, at least about 80 percent by weight of the carboxylic acids should be linear, straight chain, saturated acids containing from 12 to 18 carbon atoms. The presence of unsaturation in the fatty acids has been found to contribute to the discoloration of the soap bars as initially formed as well as the further discoloration over time. Accordingly, the fatty acids used in the soap bars of the present invention should have a low degree of unsaturation. The degree of unsaturation in fatty acids is often indicated by the iodine number or iodine value, both of these terms used interchangeably herein. The iodine number may be determined by such methods as AOAC Official Method 920.158, which is incorporated herein by reference (Official Methods of Analysis of AOAC International, edited by Patricia Cunniff, Sixteenth Edition, 1995, Volume II, Chapter 41, page 6–7). The fatty acids from which the present soap bars are derived preferably have an iodine number of less than about 5, and more preferably have an iodine number less than about 2.0

The presence of straight chain C6 to C10 acids or salts derived therefrom in the soap bars is believed to cause irritation of the skin. Accordingly, the carboxylic acids from which the soap bars of the present invention are derived preferably contain less than about 0.5 percent by weight of C6 to C10 linear straight chain acids.

Thus, the preferred fatty acids used in the soap bars of the present invention are low in unsaturated fatty acids and have a low concentration of C6 to C10 fatty acids. To accommodate both of these criteria, it is preferred to utilize purified single component or multiple component fatty acid fractions. Different acids can then be blended to optimize the final properties of the finished soap bar. The following are examples of fatty acids that are useful for preparing the soap bars of the present invention:

Philacid 1200® (United Coconut Chemicals) contains at least 99 percent by weight lauric acid. It is obtained by saponifying crude coconut oil and distilling the crude fatty acids so obtained. The material has an iodine value of less than 0.3.

Philacid 1400® (United Coconut Chemicals) contains at least 99 percent by weight of myristic acid. It is also obtained by saponifying crude coconut oil and distilling the crude fatty acids. This material also has an iodine value of less than 0.3.

Pristerene 490® is a commercial low iodine value fatty acid from Unichema International, The Netherlands. It is a mixture of fatty acids with the following typical composition:

4% lauric/myristic acids
46% palmitic acid
49% stearic acid
1% oleic acid.

The carboxylic acids from which the soap bars of the present invention are derived comprise from about 2.0 to about 20 percent by weight of C8 to C18 branched chain carboxylic acids. The branched chain acids serve to break up the crystallinity of the carboxylic acid salts, thereby enhancing the clarity of the soap bar. Illustrative examples of branched chain acids that are useful in the soap bars of the present invention are trialkyl acetic acids, otherwise known as neo acids, of the formula:

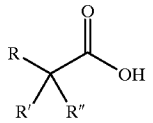

wherein R, R' and R" are all alkyl groups which may be the same or different. An example of a neo acid useful in the soap bars of the present invention is neodecanoic acid.

Other branched chain acids that are effective in the soap bars of the present invention are 2-ethyl hexanoic acid, and iso acids such as isostearic acid. An example of an iso acid useful in the soap bars of the present invention is Prisorine 3505®, (Unichema International, The Netherlands), which has the following typical composition:

2.5% lauric/myristic acid, 10% branched C16 acids, 6% linear palmitic acid, 65% branched C18 acids, 2% linear stearic acid, 2.5% oleic acid, 8% branched C20 acids and 4% C22 acids. Thus, this material contains a total of about 83 weight percent branched carboxylic acids.

The soap bars of the present invention contain about 35 to about 60 percent, preferably about 40 to about 45 percent by weight of a solvent mixture. The solvent mixture comprises triethanolamine and water containing from about 65 to 85 percent, preferably about 70 to about 75 percent by weight of triethanolamine. Thus, in the preparation of the soap bar of the present invention, fatty acids are preferably neutralized with sodium hydroxide and triethanolamine, with sufficient excess of triethanolamine to provide the amount required for the solvent mixture. The presence of the solvent mixture in the soap bar further enhances the clarity of the obtained soap bar.

The soap bars of the present invention contain a discoloration-retarding effective amount of an antioxidant to stabilize the discoloration of the bar with time. Suitable antioxidants include alkylated phenols such as butylated hydroxy toluene (BHT) and butylated hydroxy anisole (BHA), and Vitamin E (DL-α-tocopherol) and its derivatives such as Vitamin E acetate. A combination of antioxidants, such as BHT and Vitamin E, has been found to be especially effective at retarding the discoloration of the soap bars of the invention. For example, a soap bar preferably contains 0.001 to about 0.1 percent by weight of BHT and 0.01 to about 1.0 percent by weight of Vitamin E. More preferably, the bar contains from 0.005 to about 0.05 percent by weight of BHT and about 0.05 to about 0.5 percent by weight of Vitamin E.

The soap bars of the present invention may also contain suitable ancillary agents. Examples of such agents are foam stabilizers, humectants, emollients, chelating agents and fragrances. The foam stabilizers that may be useful in the soap bars of the present invention include alkyl monoethanolamides, alkyl diethanolamides, acyl sarcosinates, acyl taurates, acyl isethionates, acyl lactates, alkyl amine oxides, alkyl betaines and mixtures thereof. An example of a useful and effective foam stabilizer is cocamide DEA, the diethanolamide derived from coconut fatty acids with diethanolamine. This material may also be referred to as coco diethanolamide.

Humectants that may be useful in the soap bars of the present invention include glycerine, propylene glycol, butylene glycol, polyethylene glycol, and mixtures thereof. Glycerine is a preferred humectant in the soap bars of this invention. The presence of humectants in the soap bar leave the user with the feeling that the soap does not dry out the skin after use.

Emollients that may be useful in the soap bars of the invention include mineral oil, vegetable oil, silicone oils, synthetic and semisynthetic emollient esters and mixtures thereof. Mineral oil is a preferred emollient. The presence of emollients in the soap bar leaves the user's skin with a soft, silky feeling after use of the soap bar.

The presence of heavy metal ions is believed to catalyze reactions that contribute to discoloration of the soap. Accordingly, it is advantageous to include chelating agents in the soap bar formulation. Examples of chelating agents that may be used include the tetrasodium salt of ethylenediamine tetraacetic acid (EDTA) and the pentasodium salt of diethylenetriamine pentaacetic acid (Na5DTPA).

The following examples are illustrative of the soap bars of the present invention without intending to limit the invention in any manner. In the following examples, amounts of materials used are expressed in parts by weight based on a total of 100 parts of material added to the soap bar formulation.

EXAMPLE 1

The following ingredients were charged to a stirred, jacketed Britannia reaction tank pre-heated to 65 to 70° C.:

| Ingredient | Chemical Name | Parts by weight |
|---|---|---|
| Prisorene 3505 ® | Isostearic Acid | 4 |
| Pristerene 4900 ® | Palmitic/Stearic Acid | 17 |
| Philacid 1200 ® | Lauric Acid | 13 |
| Philacid 1400 ® | Myristic Acid | 6.3 |

The combined fatty acids have an iodine value of 0.6 and contain 0.2 percent by weight of C6 to C10 straight chain carboxylic acids.

Heating of the acid mixture was continued until its temperature is 60° C. 1.2 parts of a 33.3 percent by weight solution of sodium hydrosulfite was added, and the mixture was stirred for 10 minutes. 0.01 parts of BHT were then added. The acids were neutralized by the addition of 55.1 parts of a solution containing 7.7% sodium hydroxide, 75.5% triethanolamine and 16.8% water, the percentages of each of these components being percent by weight. The rate of addition was controlled to maintain the temperature of the acids between 78 and 80° C. The following ingredients were then added:

| Ingredient | Chemical Name | Parts by weight |
|---|---|---|
| Versenex 80 | Na5DTPA (% in $H_2O$) | 0.5 |
| | Glycerine | 1.0 |
| | mineral oil | 0.5 |
| | coco diethanolamide | 1.0 |
| Fragrance | — | 0.4 |
| | Vitamin E | 0.1 |

The molten soap was poured into molds and allowed to cool to room temperature. When the soap achieved the desired level of hardness, the soap was subjected to cutting, stamping and finishing operations.

The finished soap had the composition shown in the following Table 1:

TABLE 1

| Component | Composition (percent by weight) |
|---|---|
| sodium soap | 27.4 |
| triethanolamine soap | 24.7 |
| water | 12.0 |
| triethanolamine | 32 |
| sodium hydrosulfite | 0.4 |
| BHT | 0.01 |
| Glycerine | 1.0 |
| mineral oil | 0.5 |
| coco diethanolamide | 1.0 |
| fragrance | 0.4 |
| pentasodium-diethylenetriaminepenta acetate | 0.5 |
| Vitamin E | 0.1 |

The clarity of the soap was assessed by measuring the transmittance of 800 nm light through a 20 mm thick bar. The soap of example 1 had a percent transmittance of 52.3 when dry and 83.0 when wet.

EXAMPLE 2

The method of Example 1 was repeated wherein the fragrance and Vitamin E were omitted.

EXAMPLE 3

The method of Example 1 was repeated wherein Vitamin E was omitted.

EXAMPLE 4

The method of Example 1 was repeated wherein isostearic acid was replaced by the same amount of 2-ethyl hexanoic acid, only 0.2 parts of fragrance was added and Vitamin E was omitted.

EXAMPLES 5 THROUGH 7

The method of Example 1 was repeated with the following amounts of Vitamin E added to the formulation:

| Example # | Amount of Vitamin E added (weight %) |
|---|---|
| 5 | 0.03 |
| 6 | 0.05 |
| 7 | 0.20 |

The ingredients in each of these examples is summarized in the following Table 2:

TABLE 2

| Component | Ex. 1 | Ex. 2 | Ex. 3 | Ex. 4 | Ex. 5 | Ex. 6 | Ex. 7 |
|---|---|---|---|---|---|---|---|
| Prisorene 3505 ® | 4 | 4 | 4 | 0 | 4 | 4 | 4 |
| 2-ethyl hexanoic acid | 0 | 0 | 0 | 4 | 0 | 0 | 0 |
| Pristerene 4900 ® | 17 | 17 | 17 | 17 | 17 | 17 | 17 |
| Philacid 1200 ® | 13 | 13 | 13 | 13 | 13 | 13 | 13 |
| Philacid 1400 ® | 6.3 | 6.4 | 6.3 | 6.3 | 6.3 | 6.3 | 6.3 |
| sodium hydrosulfite | 0.4 | 0.4 | 0.4 | 0.4 | 0.4 | 0.4 | 0.4 |
| sodium hydroxide | 4.2 | 4.3 | 4.2 | 4.3 | 4.2 | 4.2 | 4.2 |
| water | 10.0 | 10.1 | 10.1 | 10.1 | 10.0 | 10.0 | 10.0 |
| triethanol-amine | 41.6 | 41.8 | 41.6 | 41.8 | 41.6 | 41.6 | 41.6 |
| Glycerine | 1.0 | 1.0 | 1.0 | 1.0 | 1.0 | 1.0 | 1.0 |
| mineral oil | 0.5 | 0.5 | 0.5 | 0.5 | 0.5 | 0.5 | 0.5 |
| coco diethanol-amide | 1.0 | 1.0 | 1.0 | 1.0 | 1.0 | 1.0 | 1.0 |
| pentasodium-diethylene-triaminepenta acetate | 0.5 | 0.5 | 0.5 | 0.5 | 0.5 | 0.5 | 0.5 |
| BHT | 0.01 | 0.01 | 0.01 | 0.01 | 0.01 | 0.01 | 0.01 |
| fragrance | 0.4 | 0.0 | 0.0 | 0.0 | N/A | N/A | N/A |
| Vitamin E | 0.10 | 0.0 | 0.0 | 0.0 | 0.03 | 0.05 | 0.20 |

The color of the soap bars immediately upon manufacture was assessed visually and compared against commercial clear bars. All of the bars made according to Examples 1 through 7 above appeared completely clear. In contrast, commercially available bars ranged in color from faint yellow to dark brown.

One method to assess colors quantitatively is by use of CIE color space values. Aspects of this method are described in American Society of Testing and Materials (ASTM) Standard Method E-308-95 and in The United States Pharmacopeia (USP23)/The National Formulary (NF18) in Section 1061 entitled Color-Instrumental Measurement, both of these references incorporated herein by reference. In this method, colors are assessed with the aid of a calorimeter. The software associated with the instrument produces three parameters, known as L*, a* and b*, which are believed to correlate with the three separate stimuli with which colors are perceived by the human visual cortex. In this method, the L* parameter measures the change in sample appearance along a gray scale, which ranges from 0 for theoretical black to 100 for white. The a* and b* parameters measure the red-versus-green and yellow-versus-blue attributes of the sample, respectively. Increases in the value of the a* parameter correlate with increasing redness in the sample. Increases in the b* parameter correlate with increasing yellow color in the sample.

The appearance of the as-produced bars was assessed calorimetrically by the above-indicated method using a Hunter Associates Laboratory, Inc. Miniscan Portable Spectrocolorimeter. Colorimetric values were determined using bars of 20 mm thickness. The results are presented in Table 3 below:

TABLE 3

| Bar | Appearance | Iodine Value | Transmittance[1] (% @ 800 nm) Dry | Wet | L* | a* | b* |
|---|---|---|---|---|---|---|---|
| Example 1 | clear, colorless | 0.6 | 52.3 | 83.0 | 52.3 | −1.2 | 2.2 |
| Example 2 | clear, colorless | 0.6 | N/A | N/A | 52.2 | −1.1 | 2.0 |
| Commercial Bar A | faint yellow | 36.7 | 33.8 | 75.7 | 52.0 | 0.3 | 8.1 |
| Commercial Bar B | orange brown | 82.8 | 26.4 | 60.3 | 37.8 | 5.0 | 3.6 |
| Commercial Bar C | deep red | 29.0 | 43.6 | 68.1 | 34.5 | 11.9 | 11.7 |

[1]Transmittance values measured using Perkin Elmer Lambda 2 UV/VIS Spectrophotometer on a bar thickness of 20 mm and at a wavelength of 800 nm.

[2]L*, a* and b* values determined using a Hunter Associates Laboratory, Inc. Miniscan Portable Spectrocolorimeter.

The transmittance data indicate the superior clarity of the soap bars of the present invention relative to commercially available clear soap bars.

EXAMPLE 8

Samples produced by Examples 1, 3, 5, 6 and 7 were subjected to accelerated aging tests by heating to 49° C. Samples were pulled at 1-week intervals, up to a period of 8 weeks. The results of these experiments are summarized in the following Table 4:

TABLE 4

| Soap Bar of Example # | Amount on Vitamin E in soap bar (weight percent) | Number of weeks at 49° C. | Visual Color |
|---|---|---|---|
| 3 | 0 | 5 | colorless |
| 3 | 0 | 6 | yellow |
| 3 | 0 | 7 | orange |
| 3 | 0 | 8 | dark red |
| 5 | 0.03 | 7 | colorless |
| 5 | 0.03 | 8 | orange |
| 6 | 0.05 | 7 | colorless |
| 6 | 0.05 | 8 | faint yellow |
| 1 | 0.10 | 7 | colorless |
| 1 | 0.10 | 8 | faint yellow |
| 7 | 0.02 | 7 | faint yellow |
| 7 | 0.02 | 8 | orange |

From the visual appearance of the aged soap bars as reflected in the data in Table 4, it is evident that the color stability of the soap bar is enhanced at all levels of Vitamin E employed in these experiments. Furthermore, an optimum in stability exists at a Vitamin E concentration ranging from about 0.03 to about 0.2 percent by weight, and more preferably, from about 0.05 to about 0.10 percent by weight.

The order of color stability of these bars, as evidenced by their color at week 8, is as follows, going from most stable to least stable:

Example 1>Example 6>Example 7>Example 5>Example 3

Figure 2:
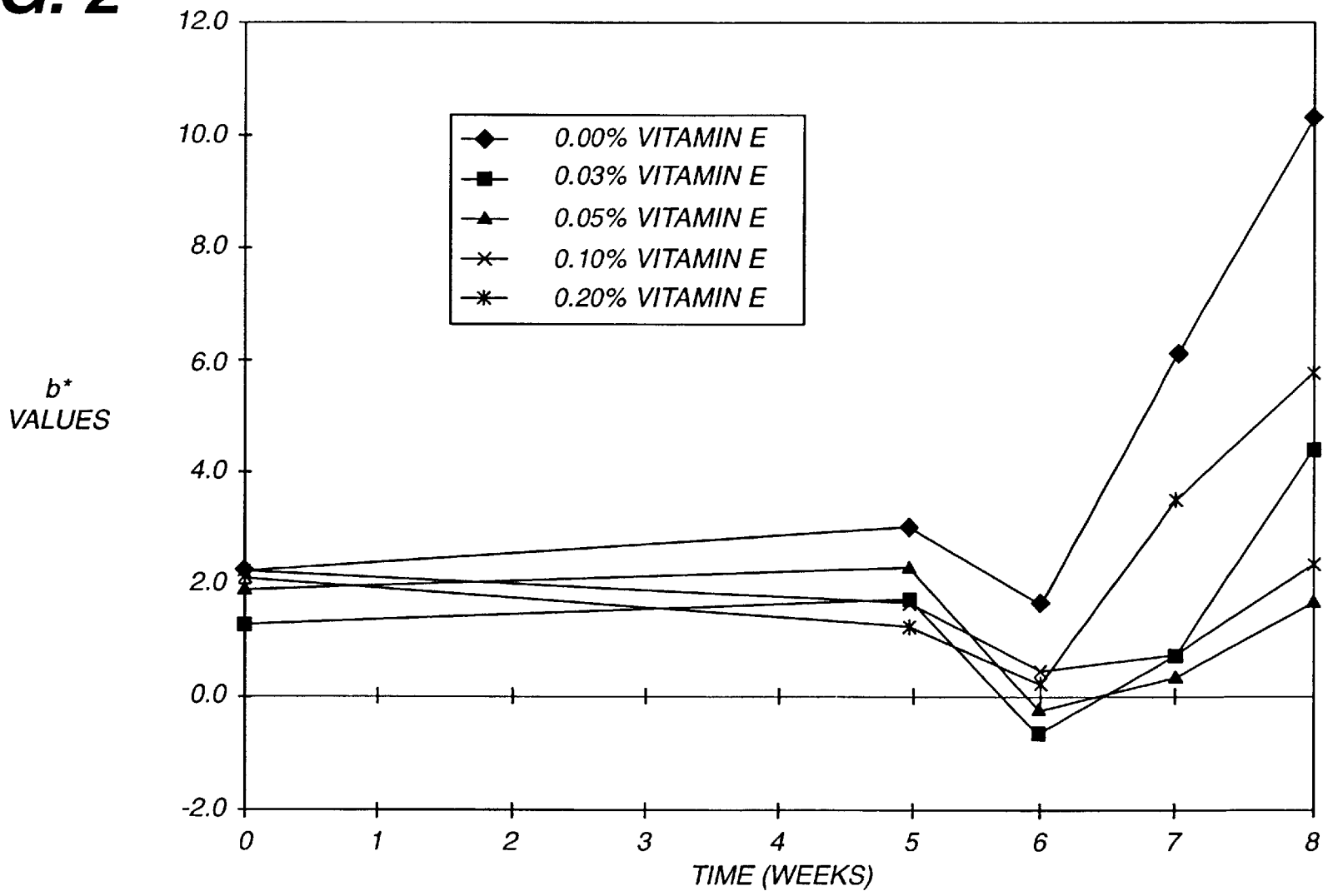
FIG. 2 is a graph showing the effect of aging on the b* color value of the soap bars of the present invention.

FIGS. 1 and 2 show the effect of various levels of Vitamin E on the a* and b* color values for the soap bars subjected to the above-described aging studies. Soap bars were pulled at one-week intervals and their color values were measured using the Hunter Associates Laboratory Miniscan Portable Spectrocolorimeter. Results for the soap bars that were subjected to these aging studies are shown in the following Table 5:

TABLE 5

| Soap Bar of Example # | Amount on Vitamin E in soap bar (weight percent) | Symbol in FIGS. 1 and 2 |
|---|---|---|
| 3 | 0 | diamond |
| 5 | 0.03 | square |
| 6 | 0.05 | triangle |
| 1 | 0.10 | X |
| 7 | 0.02 | * |

As shown in FIG. 1, even the lowest amount of Vitamin E used in the study, 0.03% had an effect on reducing the a* color values of the soap bar in the accelerated aging test. Further levels of Vitamin E to 0.20% by weight had no further effect. The effect of Vitamin E on the b* values is shown in FIG. 2, which confirms an optimum level of about 0.05 to 0.10% by weight of Vitamin E in the formulation.

EXAMPLE 9

The mildness of the soaps of the present invention was assessed using the Soap Chamber Test (P. J. Frosch and A. M. Kligman, Am. Acad. Dermatol., 1:35–41, 1979). The test is designed to measure the irritancy of soaps using 5 consecutive weekday exposures to 8% solutions with readings of scaling, redness and fissuring on the following Monday. The test was conducted according to the following procedure: A Finn chamber on Scanpor tape containing a filter paper disc was used. 100 $\mu$l of 8.0% soap solution was added by dropper onto the filter paper disc which was applied to the ventral skin of the forearm. On the first day, the fresh solutions were applied for 24 hours. On the next 4 days, the solutions were applied for 6 hours each day. The test site was evaluated on the Monday morning following the procedure using the following grading system:

Erythema
1+ Slight redness, spotty or diffuse
2+ Moderate, uniform redness
3+ Intense redness
4+ Fiery red with edema
Scaling
1+ Fine
2+ Moderate
3+ Severe with large flakes
Fissures
1+ Fine cracks
2+ Single or multiple broader fissures
3+ Wide cracks with hemorrhage or exudation The average of each of these parameters is calculated for all subjects (at least 20), and the values are summed to give a total score.

A soap bar made according to Example 4 was tested for irritancy using the above-described Soap Chamber Test. The total score for the soap bar of Example 4 was zero, indicating no detectable level of irritation. Although the presence of C6 to C10 straight chain acids is expected to contribute to irritation of the soap, the soap made according to Example 4, which contains 4% by weight of 2-ethyl hexanoic acid, a branched chain C8 acid, surprisingly shows no detectable levels of irritancy.

EXAMPLE 10

Irritation values were measured for several commercial soaps using the method of Example 9, and the results were correlated against C6 to C10 fatty acid content as shown in Table 6 below:

TABLE 6

| Soap Sample | C6 to C10 straight chain acid content (weight percent) | Irritation score |
|---|---|---|
| Example 4 | 0.2 | 0 |
| Commercial Soap D | 1.6 | 0.13 |
| Commercial Soap E | 2.3 | 0.65 |
| Commercial Soap F | 3.4 | 0.56 |

As indicated in the table, the irritation score correlates with C6 to C10 straight chain acid content with a correlation coefficient of 0.89.

I claim:

1. A clear soap bar comprising:

(a) 0.1 to 1.0 percent by weight of a reducing agent;

(b) about 40 to about 65 percent by weight of a mixture of alkali metal salts of C6 to C22 carboxylic acids and alkanolamine salts of C6 to C22 carboxylic acids;

(c) about 35 to about 60 percent by weight of a solvent mixture comprising water and alkanolamine; and (d) from about 0.001 to about 1.0 percent by weight of an antioxidant selected from the group consisting of butylated hydroxy toluene, butylated hydroxy anisole, vitamin E, vitamin E derivatives, and mixtures thereof;

wherein about 2 to about 20 weight percent of the carboxylic acids are C8 to C18 branched carboxylic acids, and wherein the carboxylic acids have an iodine number less than or equal to about 2.0.

2. The soap bar of claim 1 wherein the reducing agent is selected from the group consisting of alkali metal metabisulfite, alkali metal sulfite, alkali metal bisulfite and alkali metal hydrosulfite.

3. The soap bar of claim 2 wherein the reducing agent is alkali metal hydrosulfite at a concentration of about 0.2 to about 0.6 percent by weight.

4. The soap bar of claim 3 wherein the alkali metal is sodium and the alkanolamine is triethanolamine.

5. The soap bar of claim 1 wherein at least about 80 percent by weight of the carboxylic acids from which the carboxylic acid salts in the soap bar are derived are C12 to C18 straight chain, saturated carboxylic acids.

6. The soap bar of claim 1 wherein the alkali metal carboxylic acid salts and alkanolamine carboxylic acid salts are present in the soap bar in a weight ratio ranging from about 25:75 to about 75:25.

7. The soap bar of claim 1 wherein the alkanolamine is triethanolamine and the solvent mixture comprises from about 65 to about 85 percent by weight triethanolamine.

8. The soap bar of claim 1 wherein the antioxidant is selected from the group consisting of alkylated phenols and their derivatives, Vitamin E and its derivatives, and mixtures thereof.

9. The soap bar of claim 8 wherein the antioxidant comprises a first antioxidant selected from butylated hydroxy toluene and butylated hydroxy anisole at a concentration of about 0.001 to about 0.1 percent by weight and a second antioxidant selected from Vitamin E and Vitamin E acetate at a concentration of about 0.01 to about 1.0 percent by weight.

10. The soap bar of claim 9 wherein the first antioxidant is butylated hydroxy toluene and is present in the soap bar at a concentration of about 0.005 to about 0.05 percent by weight, and the second antioxidant is Vitamin E and is present in the soap bar at a concentration from about 0.05 to about 0.5 percent by weight.

11. The soap bar of claim 1 wherein the branched carboxylic acids are selected from the group consisting of iso acids, neo acids, 2-ethyl hexanoic acid and mixtures thereof.

12. The soap bar of claim 11 wherein the branched carboxylic acids are selected from the group consisting of isostearic acid, 2-ethyl-hexanoic acid and mixtures thereof.

13. The soap bar of claim 1 which further comprises ancillary agents selected from the group consisting of foam stabilizers, humectants, emollients, fragrances and chelating agents.

14. The soap bar of claim 13 wherein the foam stabilizer is selected from the group consisting of alkyl monoethanolamides, alkyl diethanolamides, acyl sarcosinates, acyl taurates, acyl isethionates, acyl lactates, alkyl amine oxides, alkyl betaines and mixtures thereof.

15. The soap bar of claim 13 wherein the humectant is selected from the group consisting of glycerine, propylene glycol, butylene glycol, polyethylene glycol, and mixtures thereof.

16. The soap bar of claim 13 wherein the emollient is selected from the group consisting of mineral oil, vegetable oil, silicone oils, synthetic and semisynthetic emollient esters and mixtures thereof.

17. The soap bar of claim 13 wherein the chelating agent is selected from the tetrasodium salt of ethylenediamine tetraacetic acid and the pentasodium salt of diethylenetriamine pentaacetic acid.

18. The soap bar of claim 1 wherein the carboxylic acids from which the carboxylic acid salts in the soap bar are derived comprises from zero to less than about 0.5 percent by weight of C6 to C10 linear, straight chain carboxylic acids.

19. The soap bar of claim 1 wherein the C6 to C22 carboxylic acids are entirely of plant-derived origin.

20. The soap bar of claim 1 wherein:

(a) the reducing agent is sodium hydrosulfite, present at a concentration of about 0.2 to about 0.6 percent by weight;

(b) the alkali metal is sodium and the alkanolamine is triethanolamine and the soap bar comprises from about 40 to about 65 percent by weight of sodium and triethanolamine salts of C6 to C22 carboxylic acids;

(c) at least about 80% by weight of the carboxylic acids from which the carboxylic acid salts in the soap bar are derived are C12 to C18 linear, straight chain, saturated carboxylic acids;

(d) the solvent mixture comprises water and triethanolamine, the solvent mixture comprising from about 65 to about 85 percent by weight triethanolamine;

(e) the antioxidant comprises a first antioxidant and a second antioxidant, wherein the first antioxidant is butylated hydroxy toluene and is present in the soap bar at a concentration of 0.005 to about 0.05 percent by weight, and the second antioxidant is Vitamin E and is present in the soap bar at a concentration from about 0.05 to about 0.5 percent by weight; and (f) the branched carboxylic acid is selected from the group consisting of isostearic acid, 2-ethyl-hexanoic acid and mixtures thereof.

21. The soap bar of claim 20 wherein the carboxylic acids from which the carboxylic acid salts in the soap bar are derived comprises from zero to less than about 0.5 percent by weight of C6 to C10 linear, straight chain carboxylic acids.

22. A clear soap bar comprising:

(a) sodium hydrosulfite, present at a concentration of about 0.2 percent to about 0.6 percent by weight;

(b) about 50 to about 55 percent by weight of a mixture of sodium and triethanolamine salts of $C_6$ to $C_{22}$ carboxylic acids, the weight ratio of said sodium salts to said triethanolamine salts being from about 45:55 to about 55:45;

(c) at least about 90 percent by weight of the carboxylic acids from which the carboxylic acid salts are derived are $C_{12}$ to $C_{18}$ linear, straight chain saturated carboxylic acids;

(d) about 40 to about 45 percent by weight of a solvent mixture, said solvent mixture further comprises water and from about 65 percent to about 85 percent by weight triethanolamine;

(e) butylated hydroxy toluene at a concentration of about 0.005 percent to about 0.05 percent by weight and Vitamin E at a concentration of about 0.1 percent by weight; and (f) the remaining percentage of the carboxylic acids from which the carboxylic acids salts are derived are branched carboxylic acids selected from the group consisting of isostearic acid, 2-ethyl-hexanoic acid and mixtures thereof, and wherein said branched carboxylic acids comprise from about 2 to about 10 percent by weight of the total of the carboxylic acids from which the soap bar is derived.

23. The soap bar of claim 22 wherein the carboxylic acids from which the carboxylic acid salts in the soap bar are derived comprises from zero to less than about 0.5 percent by weight of C6 to C10 linear, straight chain carboxylic acids.

* * * * *